US005210916A

United States Patent [19]

Enderlin

[11] Patent Number: 5,210,916

[45] Date of Patent: May 18, 1993

[54] MACHINE FOR CRIMPING YARNS WITH POSITIVE DRIVING OF THE YARNS

[75] Inventor: Robert Enderlin, Morschwiller le Bas, France

[73] Assignee: Superba, Mulhouse, France

[21] Appl. No.: 944,992

[22] Filed: Sep. 15, 1992

[30] Foreign Application Priority Data

Sep. 18, 1991 [FR] France ..... 1 11488

[51] Int. Cl.[5] ..... D02G 1/14

[52] U.S. Cl. ..... 28/278

[58] Field of Search ..... 28/262, 274, 278

[56] References Cited

U.S. PATENT DOCUMENTS

| | | | |
|---|---|---|---|
| 2,972,795 | 2/1961 | Backer et al. | 28/262 X |
| 4,977,654 | 12/1990 | McCullough, Jr. et al. | 28/278 |
| 4,979,274 | 12/1990 | McCullough, Jr. et al. | 28/278 |
| 5,074,016 | 12/1991 | Meyer | 28/263 |

FOREIGN PATENT DOCUMENTS

| | | | |
|---|---|---|---|
| 650565 | of 1964 | Belgium | 28/278 |
| 2652359 | 2/1992 | France . | |
| 2655064 | 9/1992 | France . | |
| 692236 | 6/1953 | United Kingdom . | |
| 1198613 | 7/1970 | United Kingdom | 28/262 |
| 1285969 | 8/1972 | United Kingdom . | |
| 9207981 | 5/1992 | World Int. Prop. O. | 28/278 |
| 9207982 | 5/1992 | World Int. Prop. O. | 28/278 |

*Primary Examiner*—Clifford D. Crowder
*Assistant Examiner*—John J. Calvert
*Attorney, Agent, or Firm*—Young & Thompson

[57] ABSTRACT

A machine for crimping yarns has an elongate chamber (14) with, at one end, an opening (15) for introducing the yarn (1) to be crimped and, at the other end, an opening (16) for exiting the crimped yarn. The wall (17) of the chamber (14) includes an elongate opening (18) parallel to the axis of the chamber, in which fingers (19), uniformly distributed along the opening (18) are engaged. A drive (20) is provided for moving the fingers (19) in order to permit them to move the crimped yarn positively towards the exit opening (16) of the chamber (14).

10 Claims, 5 Drawing Sheets

MACHINE FOR CRIMPING YARNS WITH POSITIVE DRIVING OF THE YARNS

Figure 1:
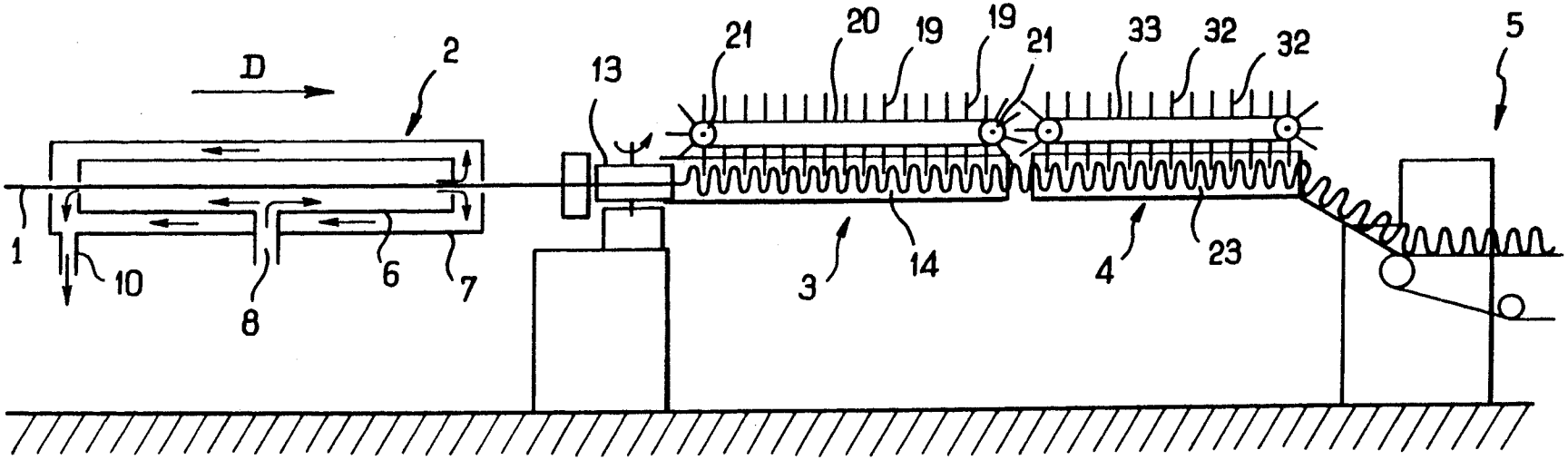

The present invention relates to a machine for crimping yarns.

This machine is applicable, in principle, to all yarns to be crimped, such as polyamides, polyesters, polypropylenes, acrylics, wools and their mixtures. These yarns can be simple yarns or folded yarns.

The crimping machine can be placed between the supply creel and the inlet of a heat-setting installation such as described, for example, in French Patent Application 2,655,064 in the name of the Applicant Company.

The crimped and heat-set yarns obtained can be used in the manufacture of rugs and carpets.

A crimping machine treats simultaneously a large number of yarns.

In the case of continuous filaments of the BCF type, the yarns are firstly introduced into a so-called "false twist" drum set into a movement of alternate rotation of variable amplitude. The yarns are then driven by pinching between two rollers and introduced into a compression chamber in which they undergo the actual crimping operation.

After this crimping operation, the yarns travel along a chute as far as a belt conveyor of the heat-setting installation.

In the case of yarns other than those of the BCF type, the aforementioned "false twist" operation is short circuited and the yarns are introduced directly between the two drive rollers.

A crimping machine of the above type has been described, for example, in French Patent Application 89/12,968 of Sep. 28, 1989 in the name of the Applicant Company.

This crimping machine includes a steam circuit permitting steam to be injected into the compression chamber. This steam injection permits the "bulk" of the yarn to be increased, the crimping to be set and amplified and said crimping to be stabilized before its entry into the heat-setting installation.

Experience has shown however that the crimping of the yarn obtained at the exit from the crimping machine was not perfectly uniform and stable and that the quality of said yarn deteriorated during its transfer towards the heat-fixing installation. Now, the perfect uniformity and stability of the crimping of the yarn is essential for the quality of the finished product produced from this yarn.

The object of the present invention is to provide a crimping machine which remedies the defects mentioned hereinabove and which permits the quality of the crimping of the yarn to be improved considerably.

The invention thus aims to provide a machine for crimping yarns comprising an elongate chamber comprising, at one of its ends, an opening for introducing the yarn to be crimped and, at its other end, an opening for exiting the crimped yarn, means being provided for subjecting the yarn to an axial compression directed in the opposite direction to its direction of progression in the chamber.

According to the invention, this crimping machine is characterized in that the wall of the chamber includes an elongate opening parallel to the axis of this chamber, in which fingers uniformly distributed along this opening are engaged, means being provided for moving the fingers in order to permit them to move the crimped yarn positively towards the exit opening of the chamber.

The fingers engaged in the chamber thus drive the yarn in the compressed and crimped state positively towards the exit of the chamber..

These drive fingers thus make it possible to overcome the frictional forces, which can be reasonably well pronounced of the compacted yarn with the inner surface of the chamber which result especially from the moisture content, which can be reasonably high, of the yarns due to a possible prior steam treatment.

Given that the fingers drive the compacted yarn positively into the chamber, the yarn leaving the chamber has a perfectly uniform, tight and pronounced crimping.

Moreover, given that the crimped yarn is driven positively by the fingers, the rollers, normally provided upstream of the machine, no longer on their own have to ensure the advance of the yarn, so that the latter is less stressed and mechanically degraded by these rollers.

According to a preferred version of the invention, the means for moving the fingers comprise a chain wound around two toothed wheels placed close to the ends of the elongate opening, this chain carrying said fingers, one of said wheels being connected to a motor in order to rotationally drive it.

According to an advantageous version of the invention, the elongate chamber is followed by a second chamber of cross section equal to or slightly greater than that of the first chamber, this second chamber being arranged in order to relax the crimped yarn engaged in the latter, this second chamber furthermore having two perforated lateral walls, the latter, as well as the lower wall of the chamber, being surrounded by a casing, defining with said walls a space which communicates with the interior of the chamber via the perforations of said lateral walls and with the exterior via a chimney, means being provided for introducing hot air and/or steam into said space.

This second chamber, called a "relaxing chamber", precedes the installation for heat-setting the crimped yarn.

This second chamber permits the bulk of the crimped yarn leaving the compression chamber to be increased by virtue of a steam treatment. Moreover, this steam treatment stabilizes the crimping, which permits a crimped yarn having the optimum conditions for the subsequent treatment to be presented at the inlet of the heat-setting installation.

Moreover, when only hot air is introduced into the chamber, the yarn is dried so that the latter is capable of reabsorbing the steam during the subsequent treatment in the heat-setting installation, which is beneficial for the quality of the final product.

Preferably, the upper wall of the second chamber includes an elongate opening parallel to the axis of the chamber, in which fingers uniformly distributed along this opening are engaged, means being provided for moving the fingers in order to permit them to move the crimped yarn positively towards the exit opening of this second chamber.

The positive driving produced by the fingers permits the uniformity of the crimping of the yarn to be maintained during its advance in the relaxing chamber.

According to another advantageous improvement, the lateral walls of said second chamber are mounted so as to slide in a direction perpendicular to their plane in order to be able to adjust the width of said chamber.

Thus the width of the relaxing chamber may be easily adjusted, depending on the nature of the yarn, on its state of compactness, on its moisture content, etc.

This possibility therefore permits a great flexibility for adapting the relaxing chamber which goes towards improving the quality of the product obtained.

Other particular features and advantages of the invention will also emerge in the description hereinbelow.

Figure 2:
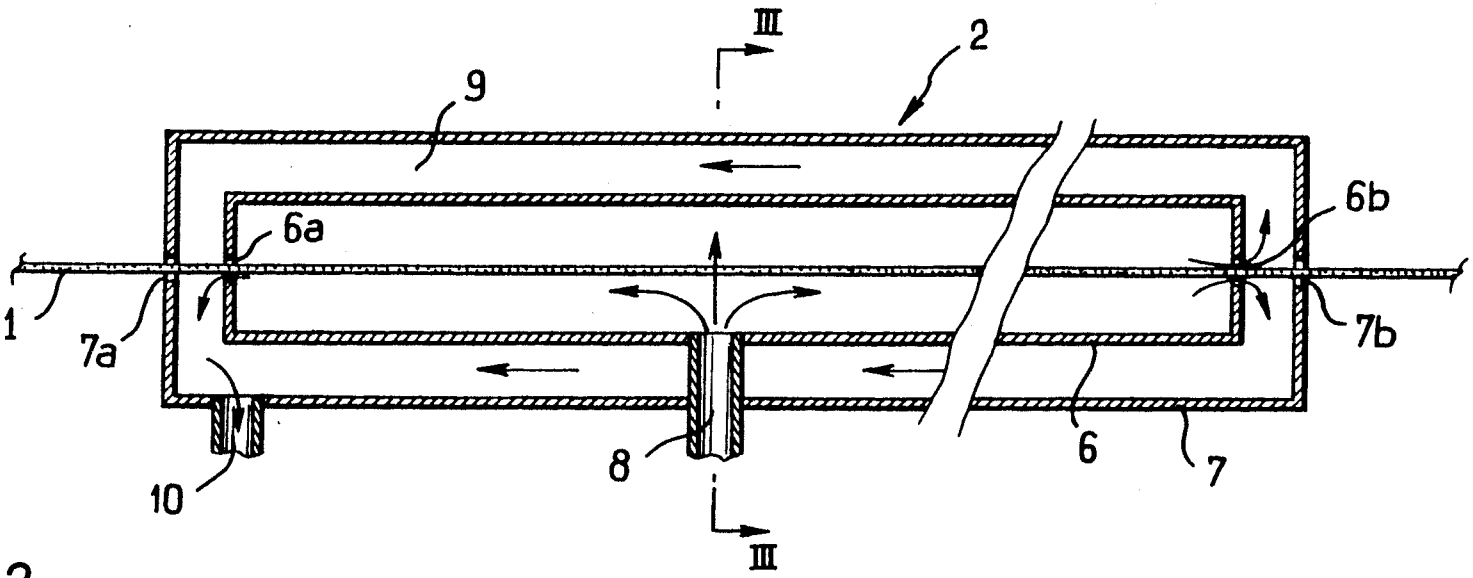
Figure 3:
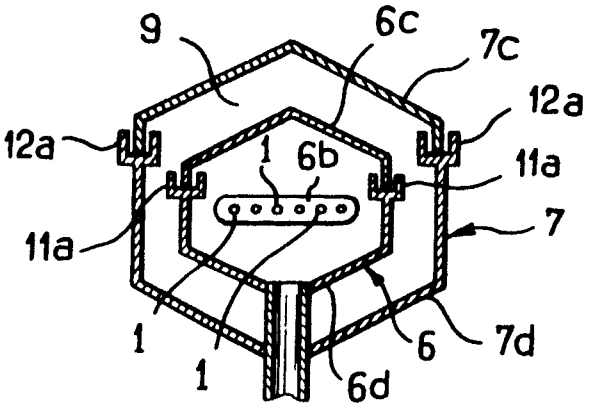
Figures 4, 5:
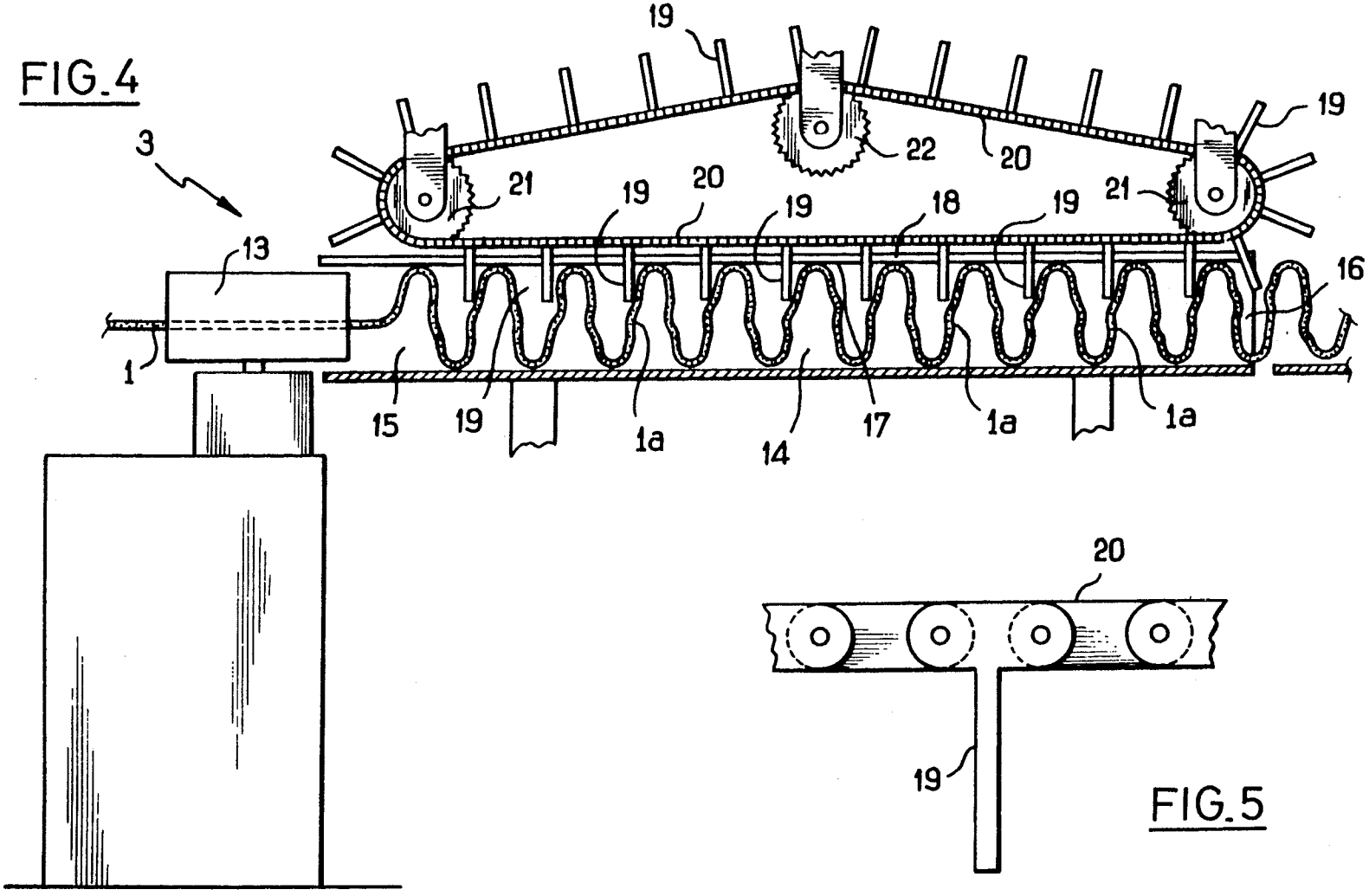
Figure 6:
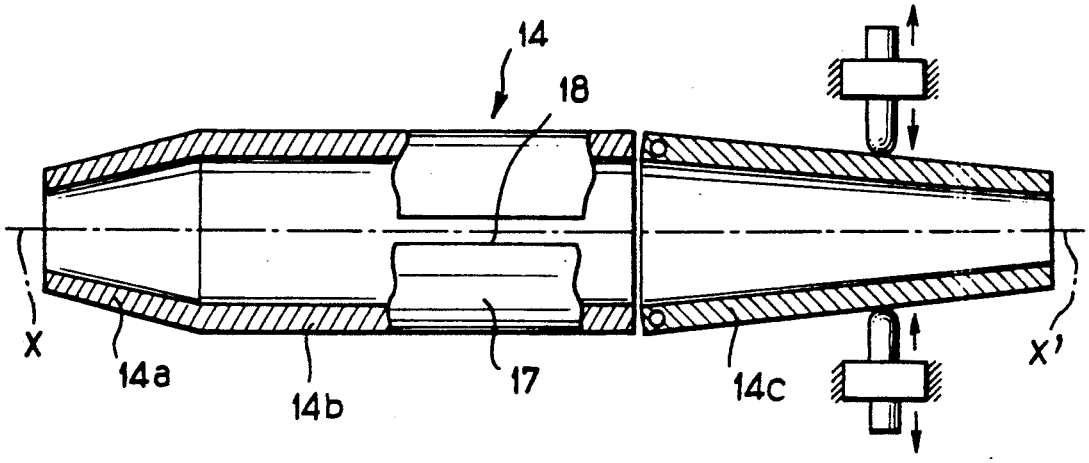
Figure 8:
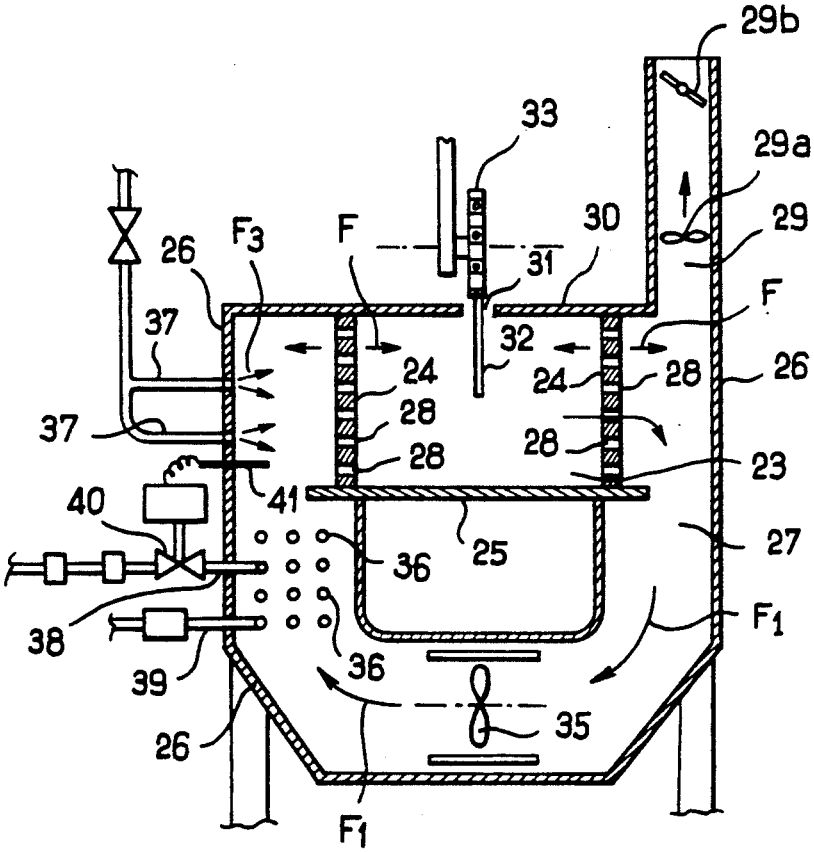
Figure 7:
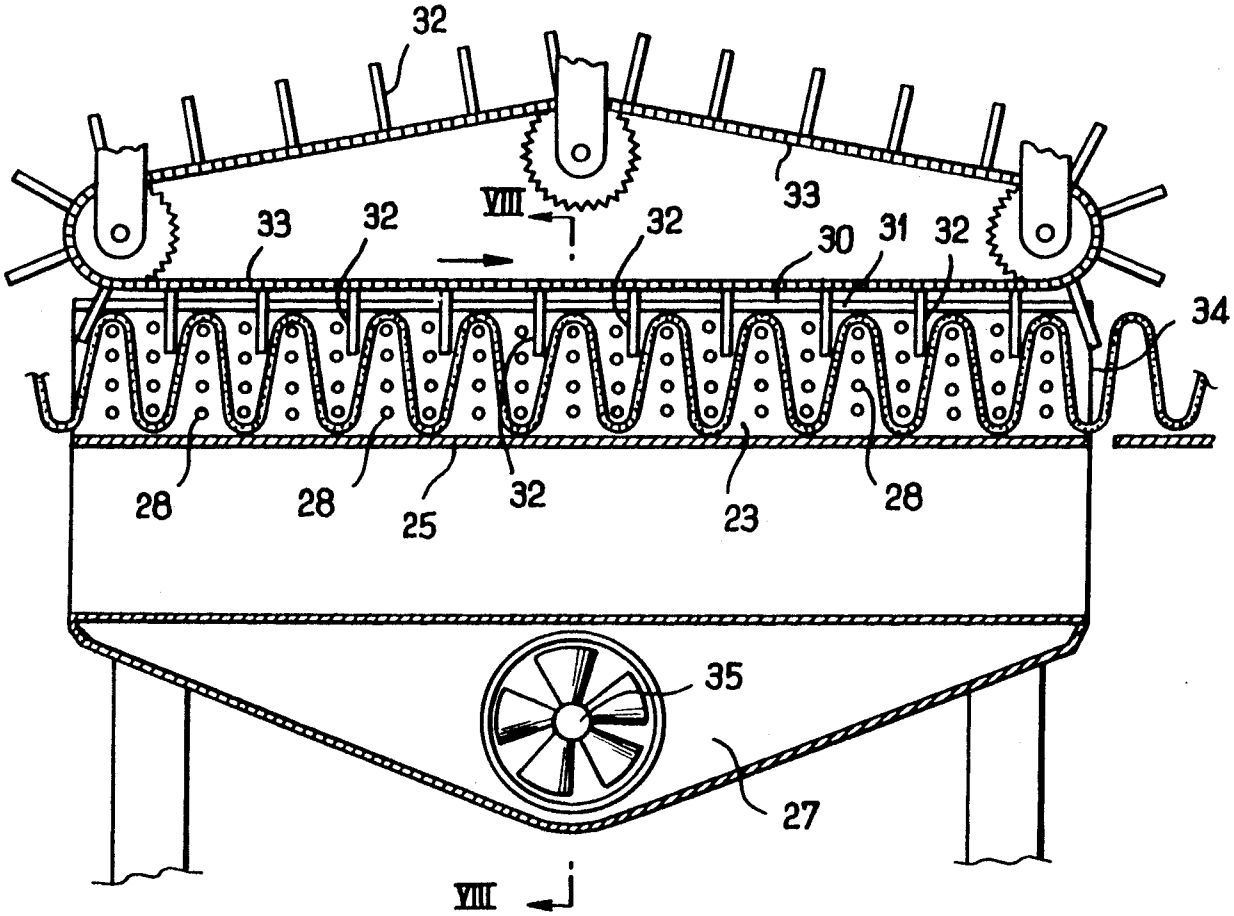

In the attached drawings, given by way of non-limiting examples:

FIG. 1 is a plan and sectional diagrammatic view of a crimping machine preceded by a presteaming chamber and followed by a relaxing chamber, FIG. 2 is a longitudinal sectional view, with a part cut out, of the presteaming chamber, FIG. 3 is a sectional view along the plane III—III of FIG. 2, FIG. 4 is a longitudinal sectional view of the crimping machine, FIG. 5 is a detailed view, on an enlarged scale, of a portion of the system for driving the crimped yarn, FIG. 6 is a longitudinal sectional and plan view of the compression chamber of the crimping machine, the drive system having been removed, FIG. 7 is a longitudinal sectional view of the relaxing chamber and its accessories, FIG. 8 is a sectional view along the plane VIII—VIII of FIG. 7.

As indicated in FIG. 1, the installation for treating a yarn 1 made from textile fibers comprises principally, following the direction of movement D of the yarn 1, a presteaming chamber 2, followed by a crimping machine 3 and by a relaxing chamber 4 which itself precedes a heat-setting installation 5. The latter can be of the type of that described in French Patent Application 2,655,064 in the name of the Applicant Company.

According to a first improvement of the invention, the yarns 1 undergo a presteaming in the chamber 2 before being introduced into the crimping machine.

This presteaming is carried out with steam which is generally under a pressure of between approximately 0.1 and 0.3 bar and at a temperature of between approximately 80° and 100° C.

The device for producing the presteaming comprises (see FIGS. 2 and 3) two substantially coaxial chambers 6, 7 including, at their opposite axial ends, openings 6*a*, 6*b*; 7*a*, 7*b* for the passage of the yarns 1.

These chambers 6, 7 are connected to a circuit for supplying pressurized steam including a steam injection nozzle 8 emerging in the first chamber 6 which is surrounded by the second chamber 7.

The first chamber 6 has openings 6*a*, 6*b* permitting the steam to escape into the space 9 between the two chambers 6, 7.

The second chamber 7 comprises an outlet nozzle 10 for the steam.

These two chambers 6, 7 are arranged upstream and in the vicinity of a crimping machine 3 which will be described later.

FIG. 2 shows that the openings 6*a*, 6*b* of the first chamber 6, which permit the steam to escape into the space 9, correspond to the openings located at the opposite axial ends of this chamber 6. However, other openings could be provided in this chamber 6.

In the embodiment shown in FIG. 3, the two chambers 6, 7 are each constituted by two half-shells 6*c*, 6*d*; 7*c*, 7*d* resting on each other by their respective edges located in a horizontal plane. The edge of the lower half-shell 6*d*, 7*d* has a groove 11*a*, 12*a* into which the edge of the upper half-shell 6*c*, 7*c* is engaged. This groove 11*a*, 12*a* is adapted for receiving the water condensed on the inner surface of the upper half-shell 6*c*, 7*c* in order to form a seal.

The steaming device 2 which has just been described operates in the following manner:

the yarns 1 to be treated continuously traverse the chamber 6 by passing successively via the axial openings 7*a*, 6*a*, 6*b*, 7*b*. The steam is injected into the inner chamber 6 via the nozzle 8. It leaves the chamber via the openings 6*a*, 6*b* and penetrates into the space 9 between the two chambers 6, 7 from which it leaves via the nozzle 10. During their passage in the chamber 6, the yarns are heated and humidified by the steam, which has the effect of imparting a certain "bulk" to them which has a beneficial effect, considering the subsequent treatments.

The space 9, filled with steam, thermally isolates the inner chamber 6 with respect to the ambient atmosphere and prevents excessive water condensation on the inner surface of the chamber The grooves 11*a*, 12*a*, however, fill up with condensation water, which forms substantially sealed water seals, permitting a slight steam overpressure to be maintained in the inner chamber 6.

The crimping machine 3 will now be described with reference to FIGS. 4, 5 and 6.

This machine 3 essentially comprises a pair of rollers 13 between which each yarn 1 is pinched and which conveys it into a compression chamber 14.

The particular structure of this compression chamber 14 has been described in French Patent Application 89/12,868 of Sep. 28, 1989 in the name of the Applicant Company.

The general shape of this chamber 14 is visible in FIG. 6.

It comprises, at its inlet, a portion 14*a* which flares out rapidly, followed by a portion 14*b* which flares out much more steadily and which terminates in a terminal portion 14*c* whose cross section narrows down steadily by virtue of two walls which can move relative to the axis X—X' of the chamber.

This particular shape of the chamber 14 results in the yarn which is engaged in the latter being subjected to a compacting operation which gives rise to the formation of turns or crimping, as indicated in FIG. 4.

Thus the machine 3 for crimping the yarns comprises, generally, an elongate chamber 14 comprising, at one of its ends, an opening 15 for introduction of the yarn 1 to be crimped and, at its other end, an opening 16 for exiting the crimped yarn. Means known per se are provided for subjecting the yarn 1 to an axial compression directed in the reverse direction of its direction of progression in the chamber 14. According to another improvement of the invention, the wall 17 of the chamber 14 includes (see FIG. 6) an elongate opening 18 parallel to the axis X—X' of this chamber 14, in which fingers 19 uniformly distributed along this opening 18 are engaged. Means are provided for moving the fingers 19 in order to permit the latter to move the crimped yarn 1 positively towards the exit opening 16 of the chamber 14.

In the example shown in FIG. 4, the means for moving the fingers 19 comprise a chain 20 wound around two toothed wheels 21 placed close to the ends of the elongate opening 18. This chain 20 carries the fingers 19 and one of the wheels 21 is connected to a motor, not shown, for rotationally driving it.

A third toothed wheel 22 is provided for tensioning the chain 20.

Of course, the chain 20 can be replaced by a belt or a cable wound around two pulleys placed close to the ends of the elongate opening, this belt carrying the fingers 19 and one of the pulleys being connected to a motor for rotationally driving it. Of course, other means for driving the fingers are possible.

In the example shown in FIGS. 4 and 6, the elongate opening 18 is made in the upper portion of the chamber 14 and the chain extends just above the opening 18. This elongate opening can also be made in the lower portion or in the lateral portion of the chamber.

The device shown in FIG. 4 operates in the following manner:

the fingers 19 driven by the chain 20 penetrate between the turns or crimping la of the yarn and thus propel the entire crimped yarn towards the exit of the chamber 14.

By virtue of these fingers 19, which are uniformly spaced by 50 mm for example, the crimped yarn 1 leaves the chamber 14 with very uniform crimping. The uniformity of this crimping has a very beneficial effect on the quality of the final product obtained.

Moreover, by virtue of this positive driving by the fingers 19, the progression of the yarn is not affected by the frictional forces along the chamber which depend on the moisture content and on the treatments which have been carried out beforehand.

As shown in FIG. 1, the elongate chamber 14 of the crimping machine is followed by a second chamber 23 which is shown in more detail in FIGS. 7 and 8. This second chamber 23 has a section equal to or slightly greater than that of the first chamber 14. This second chamber 23 is arranged in order to relax the crimped yarn 1 engaged in the latter.

This second chamber 23 furthermore has (see FIG. 8) two perforated lateral walls 24. The latter, as well as the lower wall 25 of the chamber, which are surrounded by a casing 26, defining [sic] with the aforementioned walls a space 27 which communicates with the interior of the chamber 23 via the perforations 28 of said lateral walls 24 and with the exterior via a chimney 29. Means are furthermore provided for introducing hot air and/or steam into said space 27.

The outlet chimney 29 of the relaxing chamber is intended for partial renewal with fresh air and is equipped with a fresh-air extraction fan **29*a* and with a valve 29*b* for adjusting the flow rate. The role of this chimney 29** is to reduce the moisture content of the recycled air.

FIGS. 7 and 8 also show that the upper wall 30 of the second chamber 23 includes an elongate opening 31 parallel to the axis of the chamber. Fingers 32, uniformly distributed along this opening, are engaged in this elongate opening 31. As in the case of FIG. 4, a chain 33 is provided for moving the fingers 32 in order to permit them to move the crimped yarn positively towards the exit opening 34 of this second chamber 23.

On the other hand, FIG. 8 shows that the lateral walls 24 of the second chamber 23 are mounted so as to slide in a direction (see arrows F) perpendicular to their plane in order to be able to adjust the width of this chamber 23.

Moreover, a fan 35, arranged for circulating the hot air and/or steam along a closed circuit which traverses the perforated lateral walls 24 of the chamber 23, is provided within the space 27.

On the other hand, heating means 36 for heating up the air and/or steam circulating in said space 27 are provided within the space 27.

In the example of FIG. 8, the steam is injected, at the top of the space 27, into a zone located opposite one of the perforated walls 24, via nozzles 37.

Moreover, the heating of the air blown by the fan 35 is performed by a nest of tubes 36, in which tubes the steam circulates. This nest of tubes 36 is arranged between the fan 35 and the zone for injecting the steam, so that the air blown by the fan traverses the nest of tubes 36 and is heated up by them, before penetrating into the chamber 23.

The nest of tubes 36 is connected to steam nozzles 38, 39 equipped with a pressure-reducing regulator, valves, etc. The flow rate of the steam can be adjusted by virtue of a solenoid valve 3 controlled by a temperature probe 41 arranged in the space 27.

The relaxing chamber 23, which has just been described, has numerous advantages.

On the one hand, it permits the relaxing of the crimped yarn leaving the compacting chamber 14 to be performed under optimum conditions for the following two reasons:

- by virtue of the positive driving performed by the fingers 32 which permits the uniformity of the crimping to be maintained,
- by virtue of the possibility of being able to adjust the width of the chamber 23 as a function of the nature of the yarn and of the treatment which has been applied to it.

Furthermore, the steam treatment permits the "bulk" of the yarn to be improved.

When the yarn is treated by hot air, it is dried, which permits it to reabsorb moisture under excellent conditions in the heat-setting installation.

Of course, the invention is not limited to the examples which have just been described and numerous modifications can be made to them without departing from the scope of the invention.

I claim:

1. Machine for crimping yarn comprising an elongate chamber (14) having, at one end, an opening (15) for introducing yarn (1) to be crimped and at another end, an opening (16) for exiting crimped yarn, means for subjecting the yarn to an axial compression directed in an opposite direction to a direction of progression of the yarn, wherein one of the walls (17) of the chamber (14) includes an elongate opening (18) parallel to a central axis of the chamber, fingers (19) uniformly distributed along and through the opening (18), and means (20) for moving the fingers (19) so as to move the crimped yarn positively towards the exit opening (16) of the chamber (14).

2. Crimping machine according to claim 1, wherein the means for moving the fingers (19) comprises a chain (20) wound around two toothed wheels, one of the wheels being placed close to each of the ends of the elongate opening (18), the chain (20) carrying said fingers (19), and one of the said wheels being connected to a motor to rotationally drive the chain.

3. Crimping machine according to claim 1, wherein the means for moving the fingers (19) comprises a belt or a cable wound around two pulleys, one of the pulleys being placed close to each of the ends of the elongate opening (18), the belt or cable carrying said fingers (19), and one of said pulleys being connected to a motor in order to rotationally drive the belt or cable.

4. Crimping machine according to claim 1, wherein the elongate opening (18) is made in an upper portion (17) of the chamber (14).

5. Crimping machine according to claim 1, wherein the elongate chamber (14) is followed by a second chamber (23) of cross section equal to or slightly greater than that of the elongate chamber (14), the second chamber (23) being arranged to relax the crimped yarn (1), the second chamber (23) having two perforated lateral walls (24), the two lateral walls and a lower wall (25) of the chamber (23), being surrounded by a casing (26), defining with said walls a space (27) communicating with an interior of the chamber (23) via the perforations (28) of said lateral walls (24) and with an exterior via a chimney (29), means being provided for introducing hot air, steam, or a combination thereof, into said space.

6. Crimping machine according to claim 5, wherein the upper wall (30) of the second chamber (23) includes an elongate opening (31) parallel to a central axis of the second chamber, and having fingers (32) uniformly distributed along and through the opening, means (33) for moving the fingers (32) so as to permit them to move the crimped yarn (1) positively towards an exit opening (34) of the second chamber (23).

7. Crimping machine according to claim 5, wherein the lateral walls (24) of said second chamber (23) are mounted to slide in a direction perpendicular to a plane of the lateral walls so as to adjust a width of said chamber (23).

8. Crimping machine according to claim 5, wherein a fan (35) is provided in said space and arranged to circulate hot air, steam, or a combination thereof, along a closed circuit traversing the perforated lateral walls (24) of said second chamber (23).

9. Crimping machine according to claim 5, wherein heating means (36) are provided within said space for heating the steam, air, or combination thereof, circulating in said space (27).

10. Crimping machine according to claim 5, wherein the chimney comprises an air extraction fan (29*a*) and a valve (29*b*) for adjusting a flow rate of air through the chimney (29).

* * * * *